US012553223B2

(12) United States Patent
Ruvang

(10) Patent No.: US 12,553,223 B2
(45) Date of Patent: Feb. 17, 2026

(54) MATERIAL HANDLING IMPLEMENT WITH DISPLACEABLE WEAR COMPONENT ABUTMENT

(71) Applicant: BLACK CAT WEAR PARTS, LTD., Edmonton (CA)

(72) Inventor: John A. Ruvang, Bartonville, TX (US)

(73) Assignee: BLACK CAT WEAR PARTS, LTD., Edmonton (CA)

( * ) Notice: Subject to any disclaimer, the term of this patent is extended or adjusted under 35 U.S.C. 154(b) by 843 days.

(21) Appl. No.: 17/693,708

(22) Filed: Mar. 14, 2022

(65) Prior Publication Data

US 2023/0287661 A1 Sep. 14, 2023

(51) Int. Cl.
*E02F 9/28* (2006.01)

(52) U.S. Cl.
CPC ..... *E02F 9/2825* (2013.01)

(58) Field of Classification Search
CPC ..... E02F 9/2825; E02F 9/2833; E02F 9/2883
USPC ..... 37/455, 444, 446, 452
See application file for complete search history.

(56) References Cited

U.S. PATENT DOCUMENTS 4,414,764 A 11/1983 Johansson et al.
6,986,216 B2 1/2006 Emrich et al.
2008/0092413 A1* 4/2008 McClanahan ..... E02F 9/2841 37/457
2012/0304508 A1* 12/2012 Guimaraes ..... E02F 9/2883 37/456
2013/0008062 A1* 1/2013 Guimaraes ..... E02F 9/2883 37/446
2014/0173949 A1* 6/2014 Karlsson ..... E02F 9/2833 37/455
2021/0340737 A1 11/2021 Jakubisin et al.
2023/0175237 A1* 6/2023 Weber ..... E02F 9/2841 37/455

OTHER PUBLICATIONS

Chilean Examiner's Response issued Sep. 10, 2025 for CL Patent Application No. 202303303, 20 pages.
English Translation for Chilean Examiner's Response issued Sep. 10, 2025 for CL Patent Application No. 202303303, 20 pages.

* cited by examiner

*Primary Examiner* — Christopher J Sebesta
*Assistant Examiner* — Evan A Bregel
(74) *Attorney, Agent, or Firm* — Smith IP Services, P.C.

(57) ABSTRACT

An abutment assembly for reacting forces applied to a wear component attached to a lip of a material handling implement can include a base configured to be rigidly secured to the lip, and an abutment displaceable relative to the base and configured to contact a surface of the wear component. A method of securing a wear component on a material handling implement can include rigidly attaching a base of an abutment assembly to the lip, positioning the wear component on the lip, and then displacing an abutment of the abutment assembly relative to the base. The displacing step can include the abutment contacting a surface of the wear component.

36 Claims, 8 Drawing Sheets

MATERIAL HANDLING IMPLEMENT WITH DISPLACEABLE WEAR COMPONENT ABUTMENT

BACKGROUND

This disclosure relates generally to mining, excavation and material handling equipment and, in an example described below, more particularly provides for support of a wear component on an implement.

The forward edge of material handling implements, such as buckets and shovels, etc., is subject to impacts, abrasion and other types of wear and damage. Expendable wear components, such as teeth, shrouds and adapters, can be used to protect a forward edge of a material handling implement. However, a fastening system used to releasably attach a wear component to an implement may not prevent wear and other damage due to contact between the wear component and the forward edge of the implement.

It will, therefore, be appreciated that improvements are continually needed in the art of reacting forces applied to wear components on material handling implements. Such improvements are provided to the art by the present disclosure, and these improvements can be realized in a wide variety of different configurations.

DETAILED DESCRIPTION

Figure 1:
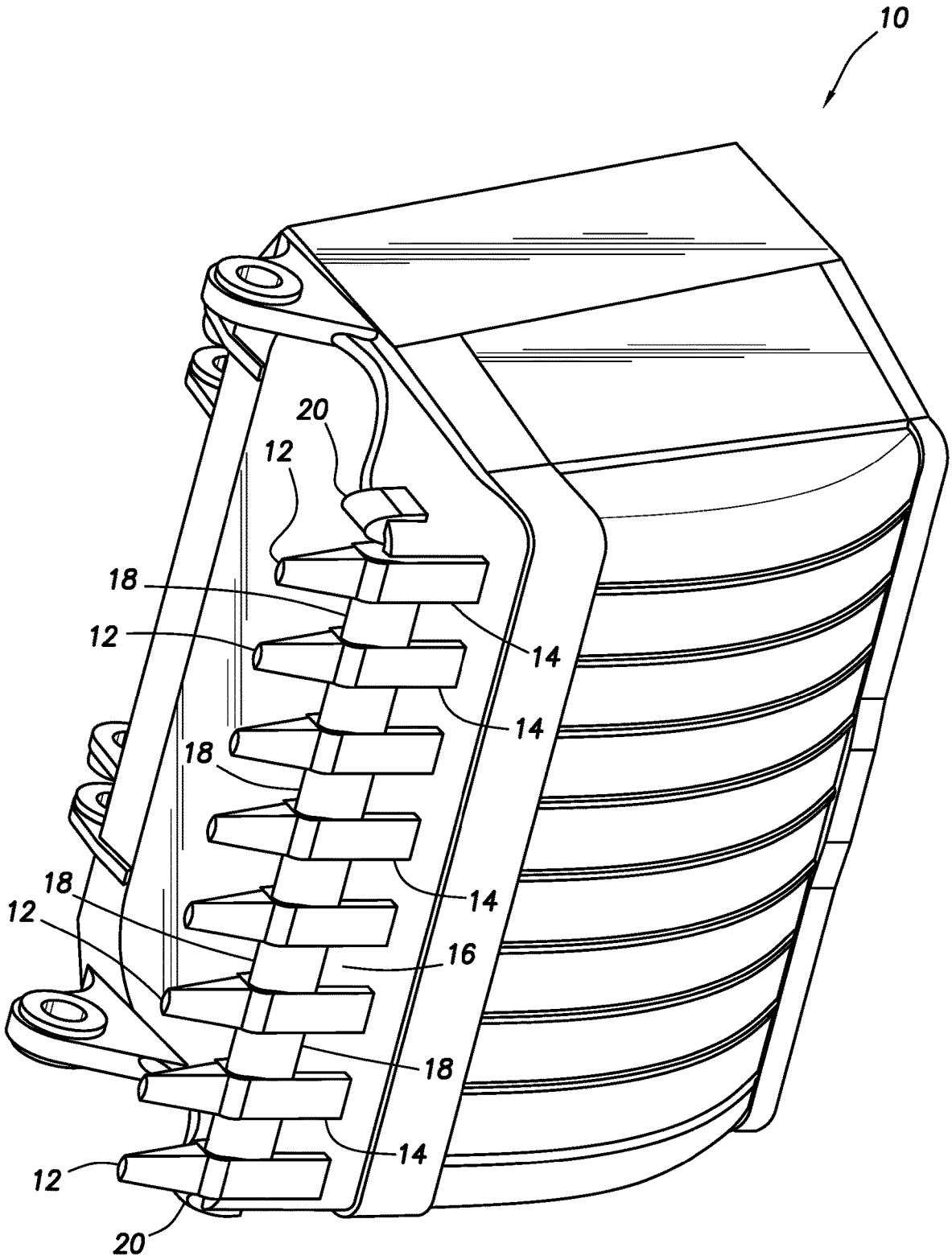
FIG. 1 is a representative partially cross-sectional view of an example of a material handling implement which can embody principles of this disclosure.

Representatively illustrated in FIG. 1 is an implement 10 for a material handling apparatus which can embody principles of this disclosure. However, it should be clearly understood that the implement 10 is merely one example of an application of the principles of this disclosure in practice, and a wide variety of other examples are possible. Therefore, the scope of this disclosure is not limited at all to the details of the implement 10 described herein and/or depicted in the drawings.

In the example of FIG. 1, the implement 10 is of the type known as a "dipper" or "bucket" of a cable shovel, but it should be clearly understood that the principles of this disclosure can be utilized with other types of excavation (or other material handling) implements. In the illustration of FIG. 1, the implement 10 is rotated so that a bottom material-engaging side of the implement is clearly visible. From this perspective, it may be seen that multiple teeth 12 are mounted on the implement 10 for piercing the earth or other material.

The teeth 12 are typically rapidly worn down or otherwise damaged during use of the implement 10, and so the teeth are replaced periodically or when excessive wear is evident. Specially configured adapters 14 releasably secure the teeth 12 to a forward edge of a lip 16 of the implement 10 in this example. In other examples, the teeth 12 may be secured directly to the lip 16.

The teeth 12 and adapter 14 are merely examples of wear components that can be securely and conveniently attached to a material handling implement using the principles of this disclosure. Other examples of wear components include shrouds 18, 20 which protect forward material-engaging edges of the lip 16 and sides of the implement 10. Thus, the scope of this disclosure is not limited to use of any particular types of wear components.

As used herein, the term "forward" is used to indicate a direction in which the implement 10 displaces to engage a material. Thus, a forward edge of the lip 16 would first engage the material, if the forward edge were not protected by the teeth 12, adapter 14 and shrouds 18, 20. The term "rearward" is used to indicate an opposite direction. Thus, in the FIG. 1 example, a rearward direction would be toward a back of the implement 10 from the forward edge of the lip 16.

Figure 2:
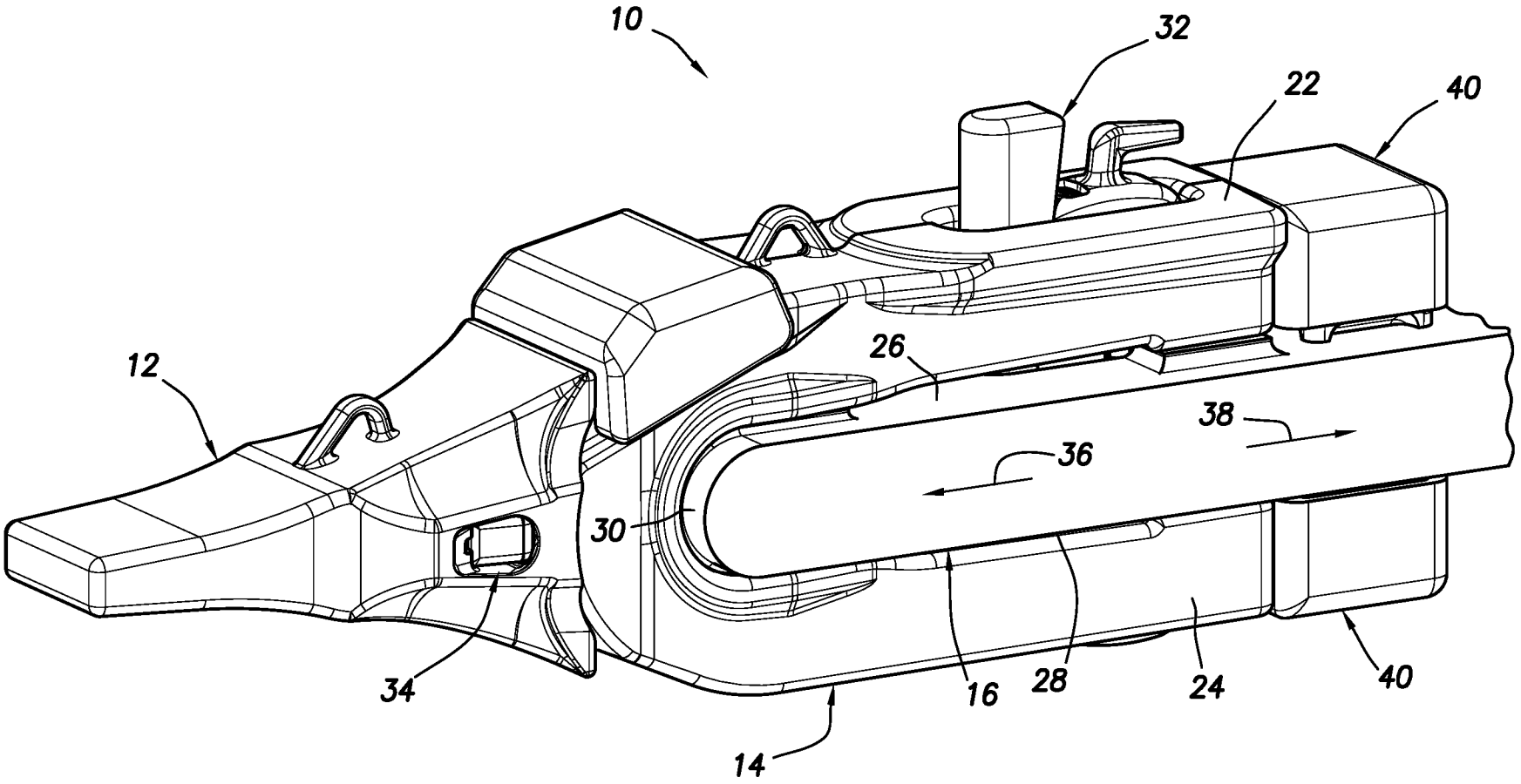
FIG. 2 is a representative partially cross-sectional view of an example of a wear component secured on the material handling implement.

Referring additionally now to FIG. 2, a partially cross-sectional view of an example of the tooth 12 and adapter 14 mounted on the lip 16 of the material handling implement 10 is representatively illustrated. The tooth 12, adapter 14 and lip 16 may be used with the FIG. 1 implement 10, or they may be used with other implements, whether for mining, excavation or other material handling purposes. The scope of this disclosure is not limited to use of any particular type of implement.

As depicted in FIG. 2, the forward direction is indicated by an arrow 36. The rearward direction is indicated by another arrow 38.

In the FIG. 2 example, the adapter 14 includes an upper "leg" 22 overlying an upper surface 26 of the lip 16, and a lower "leg" 24 overlying a lower surface 28 of the lip, so that the adapter effectively wraps around a forward edge 30 of the lip.

A fastening system 32 releasably secures the adapter 14 in position on the lip 16. In this example, the fastening system 32 is similar to a conventional "Whisler-type" fastening system, but other types of fastening systems may be used in keeping with the principles of this disclosure.

The tooth 12 is releasably secured to the adapter 14 by another fastening system 34. In other examples, the tooth 12 could be integrally formed with the adapter 14, instead of being separately attached to the adapter. Thus, the scope of this disclosure is not limited to use of any particular type of wear component on the lip 16 of the implement 10.

Two abutment assemblies 40 are secured to the lip 16 at rearward ends of the adapter legs 22, 24. The abutment assemblies 40 abut the rearward ends of the adapter legs 22, 24 and thereby prevent rearward movement of the adapter 14 on the lip 16.

Thus, the abutment assemblies 40 react rearwardly directed forces applied to the adapter 14, for example, due to engaging a material (e.g., cutting into or breaking up the earth) with the implement 10. By reacting the rearwardly directed forces applied to the adapter 14, the abutment assemblies 40 can prevent, or at least significantly reduce, wear due to contact between the adapter and the forward edge 30 of the lip 16.

Figure 3:
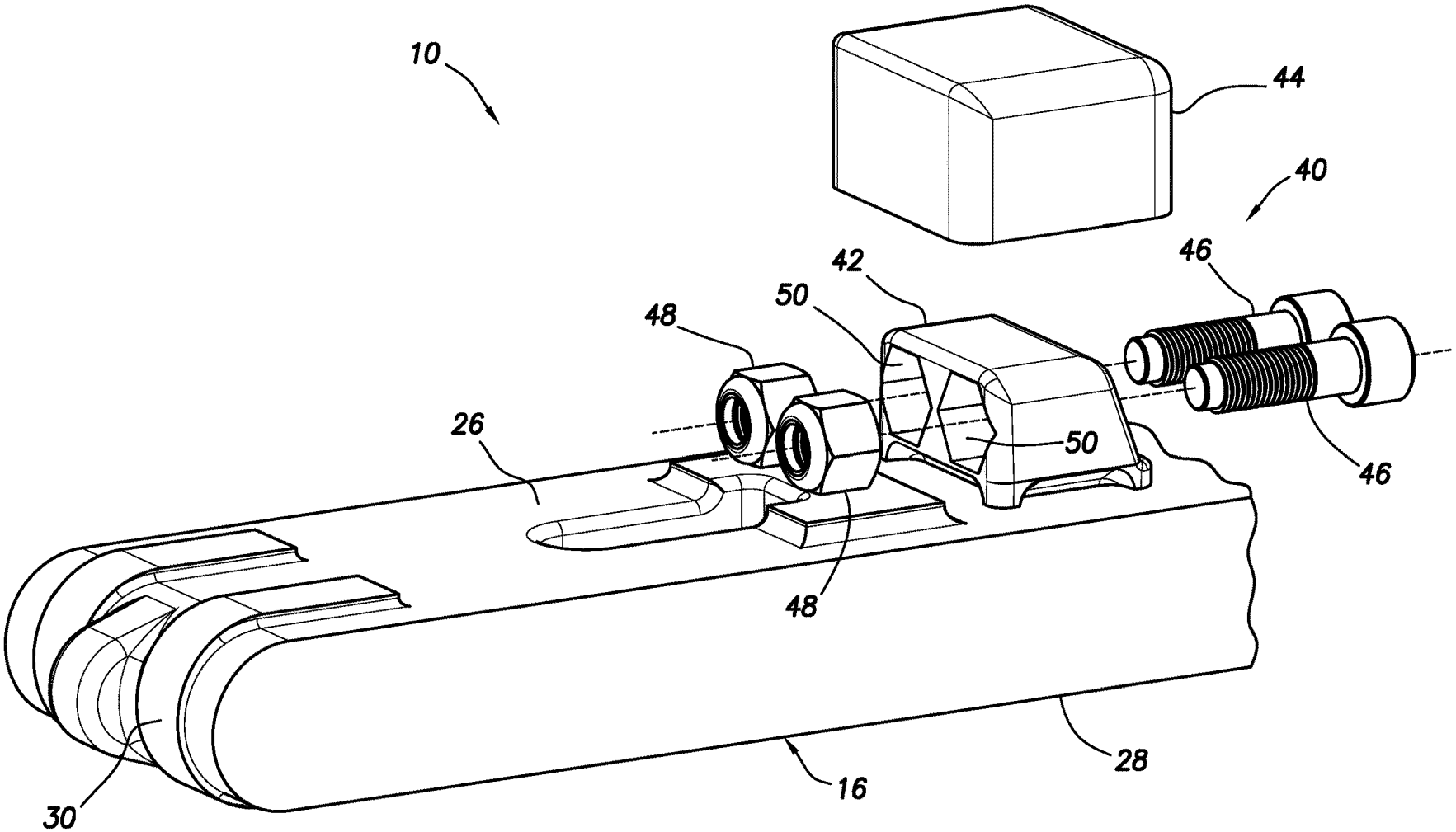
FIG. 3 is a representative forward perspective and partially cross-sectional exploded view of an example of an abutment assembly of the material handling implement.

Referring additionally now to FIG. 3, a perspective view of the implement 10, with an exploded view of one of the abutment assemblies 40 is representatively illustrated. The tooth 12 and adapter 14 are not shown in FIG. 3, so that details of the abutment assembly 40 are viewable.

In the FIG. 3 example, the abutment assembly 40 includes a base 42, an abutment 44, two externally threaded members 46, and two internally threaded nuts 48. In other examples, an abutment assembly may include other components, or other combinations or numbers of components. For example, it is not necessary for the abutment assembly 40 to include two each of the threaded members 46 and nuts 48. Thus, the scope of this disclosure is not limited to any specific details of the abutment assembly 40 as depicted in FIG. 3 or described herein.

The base 42 is rigidly secured to the upper surface 26 of the lip 16. In this example, the base 42 is welded to the lip upper surface 26. In other examples, the base 42 could be attached using other means (such as, using one or more fasteners).

The nuts 48 are received in complementarily shaped recesses 50 formed in the base 42. Engagement between the nuts 48 and the recesses 50 prevents the nuts from rotating relative to the base 42 when the threaded members 46 are threaded into the nuts 48.

Preferably, the nuts 48 are of the type that resist unthreading of the threaded members 46. For example, each nut 48 can include a nylon or other member that is deformed when a threaded member 46 is threaded into the nut, so that the deformed member resists rotation of the threaded member relative to the nut. Other types of locking nuts may be used in other examples.

Figure 4:
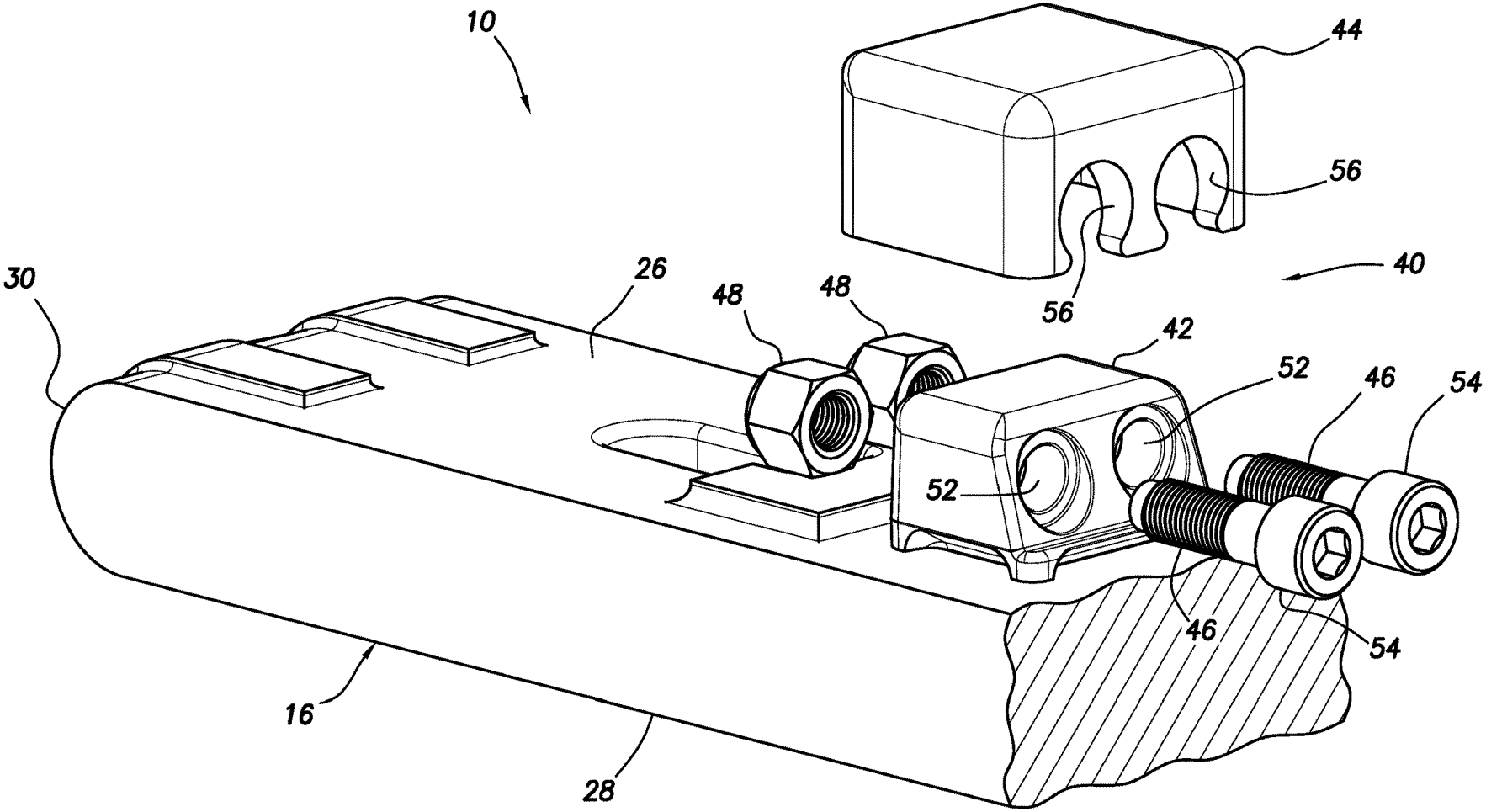
FIG. 4 is a representative rearward perspective and partially cross-sectional exploded view of the abutment assembly.

Referring additionally now to FIG. 4, it may be seen that the threaded members 46 extend through respective holes 52 formed in the base 42. The threaded members 46 engage internal threads 53 formed in the nuts 48 (see FIG. 7). In other examples, the internal threads 53 could be formed in the holes 52, so that the nuts 48 would not be used.

When the abutment assembly 40 is fully assembled, cylindrical heads 54 of the threaded members 46 are received in openings 56 formed in the abutment 44. This engagement of the heads 54 in the openings 56 retains the abutment 44 on the base 42.

To assemble the abutment assembly 40, the nuts 48 are inserted into the recesses 50 (see FIG. 3), the abutment 44 is positioned on the base 42 (thereby retaining the nuts in the recesses), and the threaded members 46 are inserted through the openings 56 and holes 52, and are threaded into the nuts. In this example, the adapter 14 is positioned on the lip 16 after the abutment assembly 40 is assembled. Note that the base 42 is welded to the lip 16 prior to assembly of the abutment assembly 40. In other examples, the base 42 could be welded or otherwise secured to the lip 16 after assembly of the abutment assembly 40, or the adapter 14 could be positioned on the lip prior to assembly of the abutment assembly.

It will be appreciated that one of the advantages of this example of the abutment assembly 40 is that the abutment 44 can be installed, removed and replaced on the base 42, without requiring any welding or removal of any welds. Instead, the abutment 44 is mechanically and releasably attached to the base 42, for example, so that the abutment can be conveniently attached or detached when desired.

Figure 5:
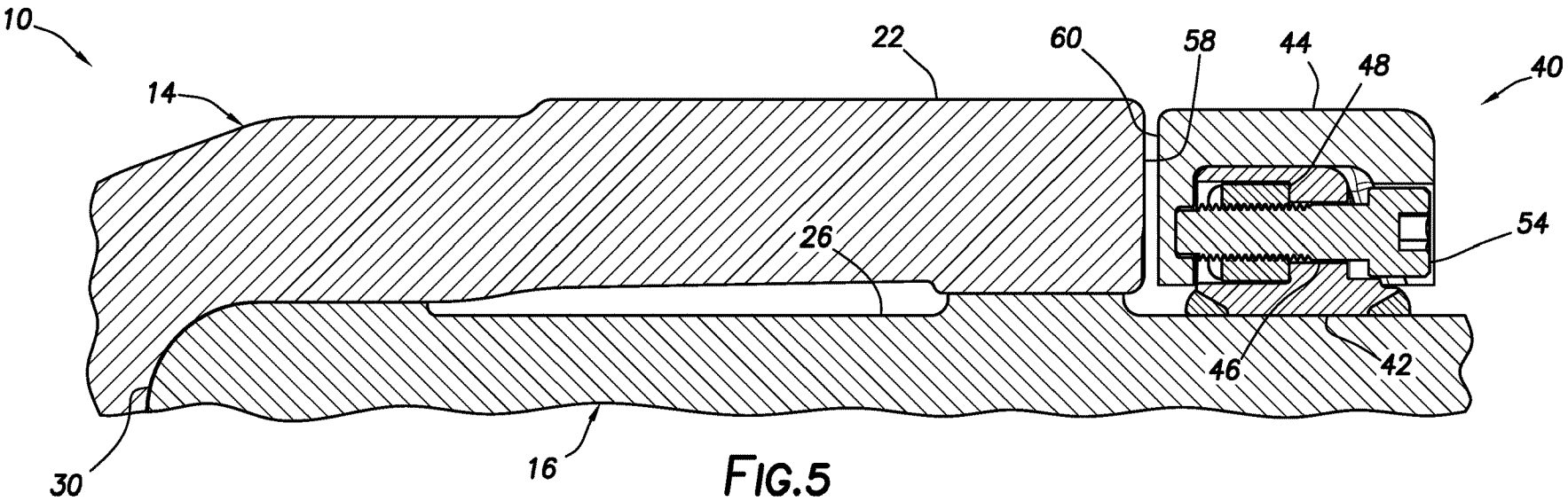
FIG. 5 is a representative cross-sectional view of an example of the wear component positioned on a lip of the material handling implement, the abutment assembly being spaced apart from a rear surface of the wear component.
Figure 6:
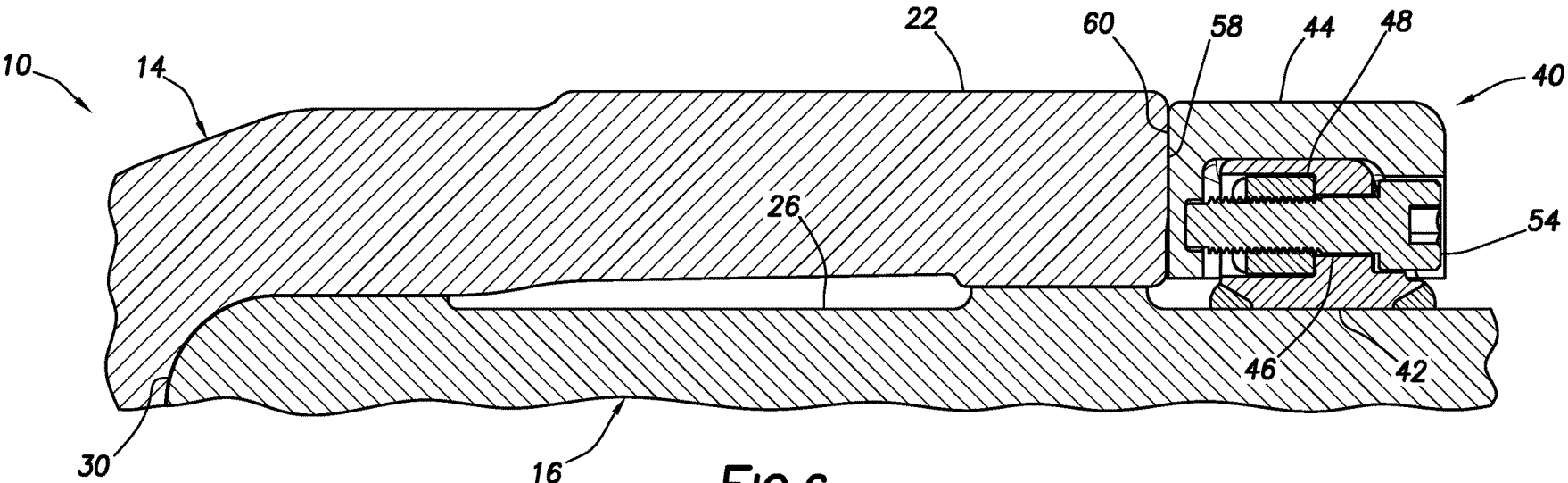
FIG. 6 is a representative cross-sectional view of the wear component positioned on the lip, the abutment assembly being displaced into contact with the rear surface of the wear component.

Referring additionally now to FIGS. 5 & 6, cross-sectional views of the abutment assembly 40 in operation are representatively illustrated. In these views, the base 42 has been welded to the upper surface 26 of the lip 16, the abutment assembly 40 has then been assembled, and the adapter 14 has been positioned on the lip 16.

As depicted in FIG. 5, the adapter 14 is displaced rearward on the lip 16, until the adapter contacts the forward edge 30 of the lip 16. The adapter 14 can then be secured to the lip 16, for example, using the fastening system 32 mentioned above (see FIG. 2).

At this point, the abutment 44 is spaced apart from the rearward end of the adapter leg 22. A rearwardly facing surface 58 formed on the adapter 14 does not contact a forwardly facing surface 60 formed on the abutment 44.

As depicted in FIG. 6, the threaded members 46 have been rotated, thereby further threading the threaded members through the nuts 48. As a result, the abutment 44 is displaced forward toward the adapter 14.

Eventually, the forwardly facing surface 60 of the abutment 44 contacts the rearwardly facing surface 58 formed on the adapter 14. In this position, the abutment 44, supported by the remainder of the assembly 40, will react rearwardly directed forces applied to the adapter 14.

Figure 7:
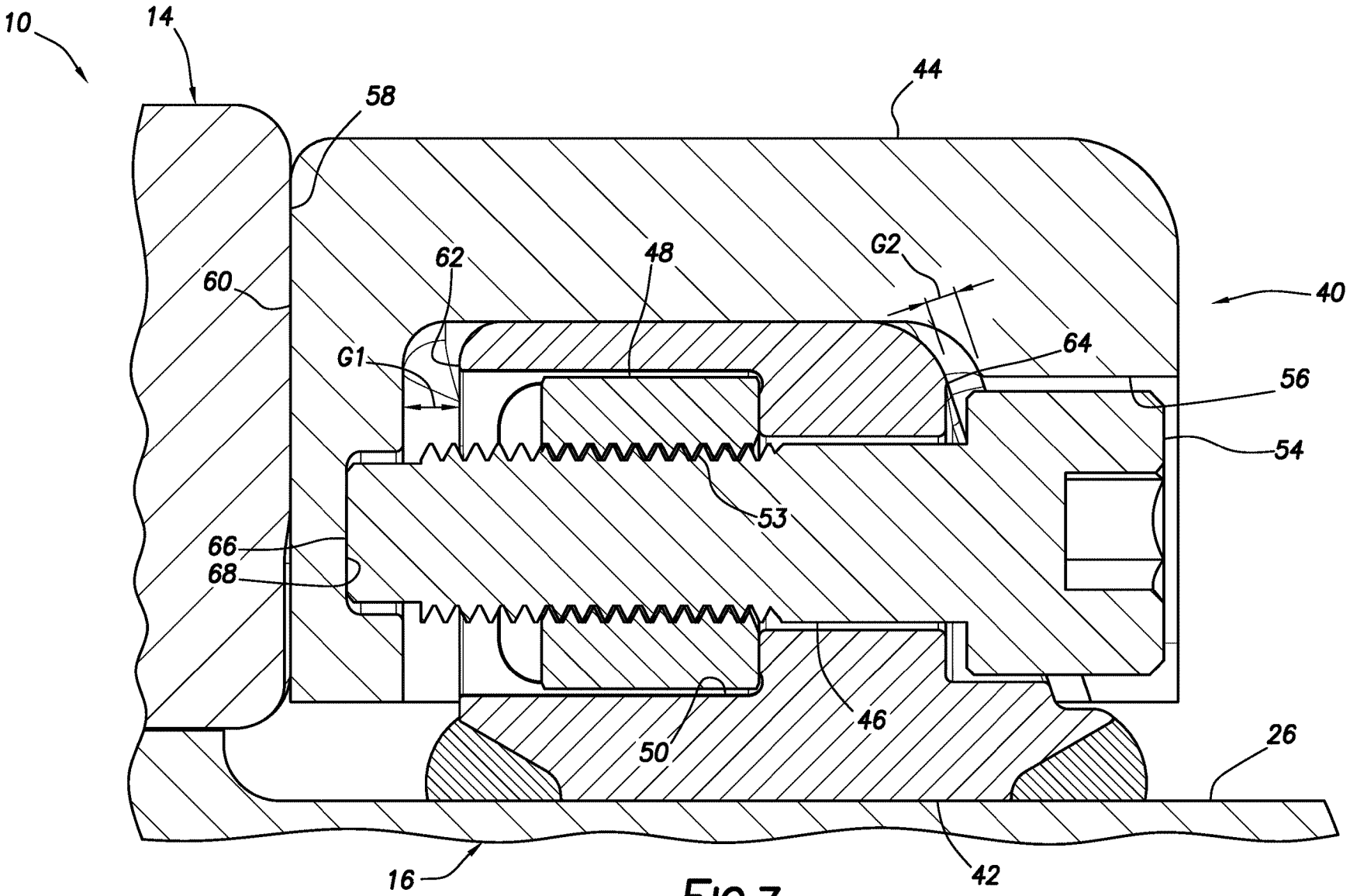
FIG. 7 is a representative cross-sectional view of the abutment assembly.

Referring additionally now to FIG. 7, a cross-sectional view of the abutment assembly 40 is representatively illustrated. In this view, the abutment 44 has been displaced forward by rotation of the threaded members 46, so that the forward surface 60 of the abutment contacts the rearward surface 58 of the adapter 14.

In this configuration of the assembly 40, note that a gap G1 is present between the abutment 44 and a forward face 62 of the base 42, and another gap G2 is present between the abutment and a rearward face 64 of the base. The gaps G1, G2 allow for variations in dimensions of the adapter 14 and assembly 40 (e.g., to provide for machining or casting tolerances), and variations in placement of the base 42 on the lip 16.

As depicted in FIG. 7, an end 66 of each of the threaded members 46 is received in a laterally extending internal recess 68 formed in the abutment 44. Engagement between the recess 68 and the ends 66 of the threaded members 46, along with the engagement of the threaded member heads 54 in the openings 56 ensures that the abutment 44 remains positioned on the base 42. In the FIG. 7 example, a diameter of the end 66 is reduced, so that deformation of the end in operation will not prevent subsequent unthreading of the threaded member 54 (e.g., when the assembly 40 is disassembled). As depicted in FIGS. 3-7. an outer perimeter of the base 42 is received in an internal cavity of the abutment 44.

Figure 8:
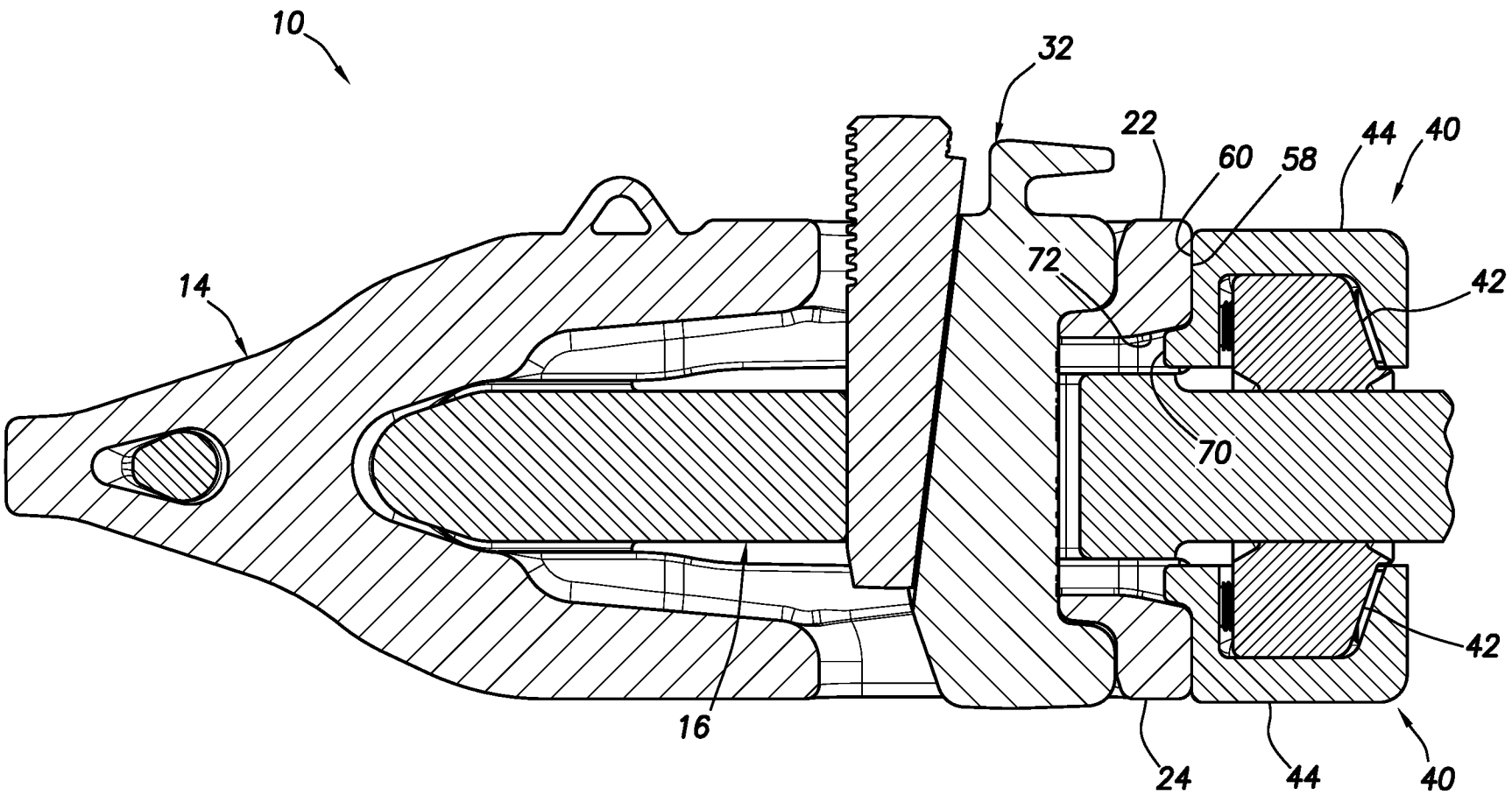
FIG. 8 is a representative cross-sectional view of another example of the abutment assembly engaged with a wear component on the lip of the material handling implement.
Figure 9:
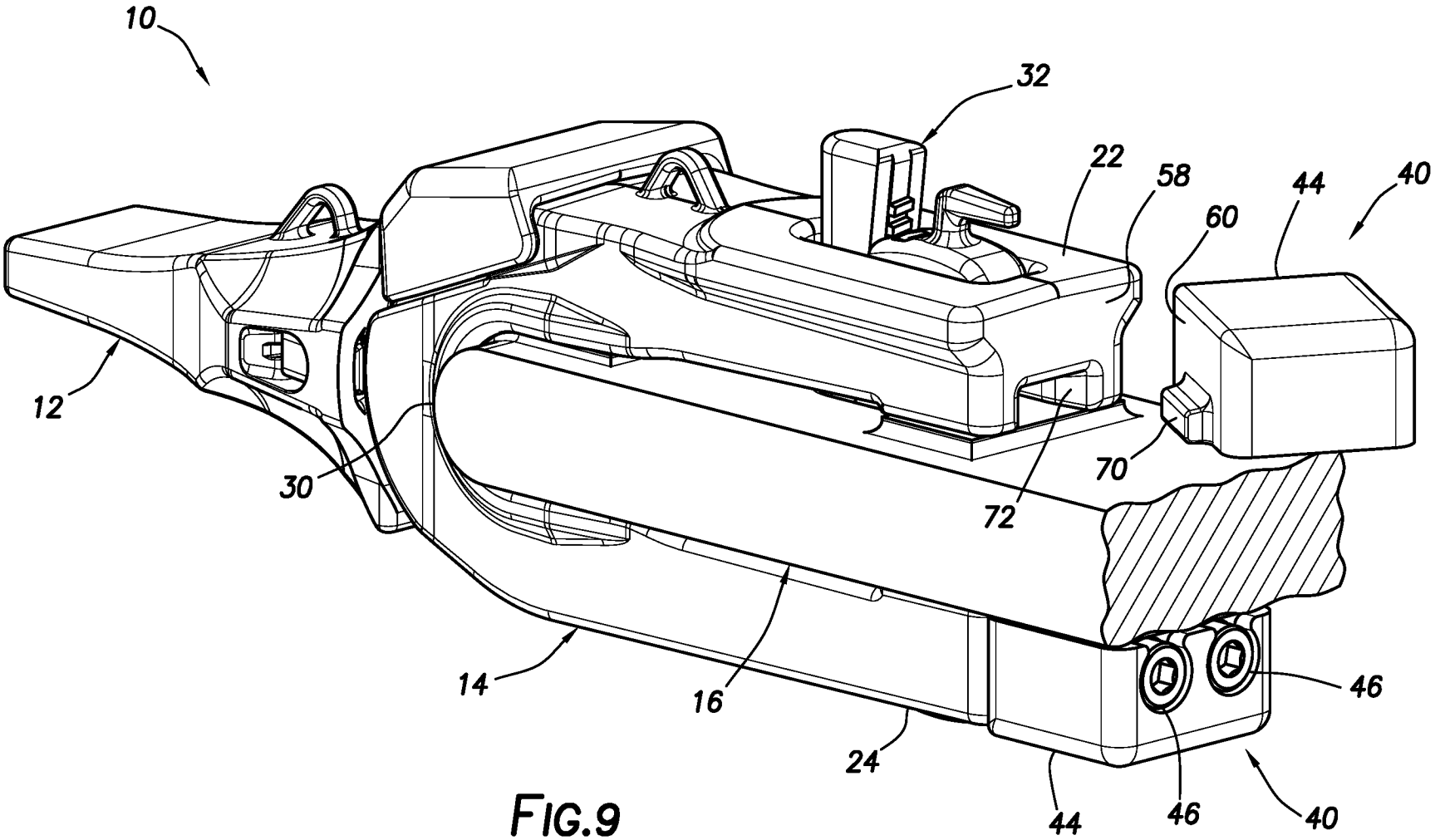
FIG. 9 is a representative rearward perspective and partially cross-sectional view of the FIG. 8 material handling implement.

Referring additionally now to FIGS. 8 & 9, cross-sectional and perspective views of another example of the material handling implement 10 are representatively illustrated. The FIGS. 8 & 9 example is similar in many respects to the FIGS. 2-7 example, and so the same reference numbers are used in FIGS. 8 & 9 to indicate similar components. In FIG. 9 the upper assembly 40 is depicted as if it is rotated away from the adapter 14, so that certain features of the assembly and the adapter are visible.

In the FIGS. 8 & 9 example, the abutment 44 includes a projection 70 extending forwardly from the forward surface 60. The projection 70 is received in a rearwardly opening recess 72 formed in the adapter 14 when the abutment 44 is displaced forward so that the surfaces 58, 60 are in contact.

The engagement between the projection 70 and the recess 72 enables the assembly 40 to react lateral forces applied to the adapter 14 in operation. This acts to stabilize the adapter 14 on the lip 16 to further reduce wear between the adapter and the lip.

It may now be fully appreciated that the above disclosure provides significant advancements to the art of reacting forces applied to wear components on material handling implements. In examples described above, the abutment assembly 40 can react forces applied to the adapter 14 in operation of the implement 10. A position of the assembly 40 on the lip 16 can be adjusted as needed to account for dimensional variations in the adapter 14, lip 16 and assembly 40. The abutment 44 is releasably attached to the base 42, and in certain examples can be attached, detached and/or replaced, without welding or removal of any welds.

The above disclosure provides to the art an abutment assembly 40 for reacting forces applied to a wear component (such as the adapter 14) attached to a lip 16 of a material handling implement 10. In one example, the abutment assembly 40 can comprise: a base 42 configured to be rigidly secured to the lip 16, and an abutment 44 displaceable relative to the base 42 and configured to contact a surface 58 of the wear component 14.

In any of the examples described herein:

The abutment assembly 40 can include a threaded adjustment member 46. The abutment 44 may be displaceable relative to the base 42 in response to rotation of the threaded member 46.

The threaded member 46 may engage internal threads 53 in the base 42. The internal threads 53 may be formed in a nut 48 received in the base 42.

The threaded member 46 may engage an internal recess 68 formed in the abutment 44, and a head 54 of the threaded member 46 may be retained in an opening 56 formed in the abutment 44 opposite the internal recess 68. The abutment 44 may be displaceable into contact with the surface 58 of the wear component 14 in response to the rotation of the threaded member 46.

The wear component surface 58 may comprise a rearwardly facing surface of the wear component 14. The wear component 14 may be in contact with a forward edge 30 of the lip 16 when the abutment 44 contacts the rearwardly facing surface 58 of the wear component 14.

The abutment 44 may include a forwardly extending projection 70 configured to engage a rearwardly opening recess 72 formed in the wear component 14. The projection 70 may be configured to react lateral forces applied to the wear component 14.

The base 42 may be configured to be welded to the lip 16. The abutment 44 may be releasably secured to the base 42 without any weld. The abutment 44 may be replaceable without removal of any weld.

A method of securing a wear component 14 of a material handling implement 10 is also provided to the art by the above disclosure. In one example, the method may comprise: rigidly attaching a base 42 of an abutment assembly 40 to a lip 16 of the implement 10; positioning the wear component 14 on the lip 16; and then displacing an abutment 44 of the abutment assembly 40 relative to the base 42. The displacing step can include the abutment 44 contacting a surface 58 of the wear component 14.

In any of the examples described herein:

The positioning step can include contacting the wear component 14 with a forward edge 30 of the lip 16. The step of contacting the wear component 14 with the forward edge 30 of the lip 16 may be performed prior to the abutment 44 contacting the surface 58 of the wear component 14.

The rigidly attaching step may include welding the base 42 to the lip 16.

The displacing step may include rotating a threaded member 46 relative to the base 42. The rotating step can include threading the threaded member 46 into a nut 48 received in the base 42. The rotating step can include receiving an end 66 of the threaded member 46 in an internal recess 68 formed in the abutment 44, and receiving a head 54 of the threaded member 46 in an opening 56 formed in the abutment 44 opposite the internal recess 68.

A first gap G1 may exist between the abutment 44 and a forward face 62 of the base 42 and a second gap G2 may exist between the abutment 44 and a rearward face 64 of the base 42 when the abutment 44 contacts the wear component surface 58.

The wear component surface 58 may comprise a rearwardly facing surface.

The displacing step may include engaging a forwardly extending projection 70 formed on the abutment 44 with a rearwardly opening recess 72 formed in the wear component 14.

The method may include releasably securing the abutment 44 to the base 42 without welding. The method may include replacing the abutment 44 without removing any weld.

A material handling implement 10 is also described above. In one example, the material handling implement 10 can comprise: a lip 16; a wear component 14 attached to the lip 16; a base 42 rigidly secured to the lip 16; and an abutment 44 displaceable relative to the base 42 and in contact with a rearwardly facing surface 58 of the wear component 14.

In any of the examples described herein:

The material handling implement 10 may also include a threaded adjustment member 46. The abutment 44 may be displaceable relative to the base 42 in response to rotation of the threaded member 46.

The threaded member 46 may engage internal threads 53 in the base 42. The internal threads 53 may be formed in a nut 48 received in the base 42.

The threaded member 46 may engage an internal recess 68 formed in the abutment 44, and a head 54 of the threaded member 46 may be retained in an opening 56 formed in the abutment 44 opposite the internal recess 68. The abutment 44 may be displaceable into contact with the surface 58 of the wear component 14 in response to the rotation of the threaded member 46.

The wear component 14 may be in contact with a forward edge 30 of the lip 16 when the abutment 44 contacts the rearwardly facing surface 58 of the wear component 14.

The abutment 44 may include a forwardly extending projection 70 configured to engage a rearwardly opening recess 72 formed in the wear component 14. The projection 70 may be configured to react lateral forces applied to the wear component 14.

The base 42 may be welded to the lip 16. The abutment 44 may be releasably secured to the base 42 without any weld. The abutment 44 may be replaceable without removal of any weld.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An abutment assembly for reacting forces applied to a wear component attached to a lip of a material handling implement, the abutment assembly comprising:

a base configured to be rigidly secured to the lip; and an abutment comprising an internal cavity configured to receive an outer perimeter of the base therein, in which the abutment is configured to be displaced into contact with a surface of the wear component after the wear component has been secured to the lip of the material handling implement.

2. The abutment assembly of claim 1, further comprising a threaded adjustment member, and in which the abutment is displaceable relative to the base in response to rotation of the threaded member.

3. The abutment assembly of claim 2, in which the threaded member engages internal threads in the base.

4. The abutment assembly of claim 3, in which the internal threads are formed in a nut received in the base.

5. The abutment assembly of claim 2, in which the threaded member engages an internal recess formed in the abutment, and a head of the threaded member is retained in an opening formed in the abutment opposite the internal recess.

6. The abutment assembly of claim 2, in which the abutment is displaceable into contact with the surface of the wear component in response to the rotation of the threaded member, and in which the surface comprises a rearwardly facing surface of the wear component.

7. The abutment assembly of claim 6, in which the wear component is in contact with a forward edge of the lip when the abutment contacts the rearwardly facing surface of the wear component.

8. The abutment assembly of claim 1, in which the abutment comprises a forwardly extending projection configured to engage a rearwardly opening recess formed in the wear component.

9. The abutment assembly of claim 8, in which the projection is configured to react lateral forces applied to the wear component.

10. The abutment assembly of claim 1, in which the base is configured to be welded to the lip.

11. The abutment assembly of claim 1, in which the abutment is releasably secured to the base without any weld.

12. The abutment assembly of claim 1, in which the abutment is replaceable without removal of any weld.

13. A method of reacting forces applied to a wear component of a material handling implement, the method comprising:

rigidly attaching a base of an abutment assembly to a lip of the material handling implement;

then attaching an abutment of the abutment assembly to the base;

then positioning the wear component on the lip of the material handling implement;

then securing the wear component on the lip; and then displacing the abutment relative to the base, the displacing comprising the abutment contacting a surface of the wear component.

14. The method of claim 13, in which the positioning comprises contacting the wear component with a forward edge of the lip.

15. The method of claim 14, in which the contacting the wear component with the forward edge of the lip is performed prior to the abutment contacting the surface of the wear component.

16. The method of claim 13, in which the rigidly attaching comprises welding the base to the lip.

17. The method of claim 13, in which the displacing comprises rotating a threaded member relative to the base.

18. The method of claim 17, in which the rotating comprises threading the threaded member into a nut received in the base.

19. The method of claim 17, in which the rotating comprises receiving an end of the threaded member in an internal recess formed in the abutment, and receiving a head of the threaded member in an opening formed in the abutment opposite the internal recess.

20. The method of claim 13, in which the wear component surface comprises a rearwardly facing surface.

21. The method of claim 13, in which the displacing comprises engaging a forwardly extending projection formed on the abutment with a rearwardly opening recess formed in the wear component.

22. The method of claim 13, further comprising releasably securing the abutment to the base without welding.

23. The method of claim 13, further comprising replacing the abutment without removing any weld.

24. A material handling implement, comprising:

a lip;

a wear component attached directly to the lip;

a base rigidly secured to the lip, in which the base is positioned rearward of the wear component; and an abutment comprising an internal cavity configured to receive an outer perimeter of the base therein, in which the abutment is displaceable relative to the base into contact with a rearwardly facing surface of the wear component.

25. The material handling implement of claim 24, further comprising a threaded adjustment member, and in which the abutment is displaceable relative to the base in response to rotation of the threaded member.

26. The material handling implement of claim 25, in which the threaded member engages internal threads in the base.

27. The material handling implement of claim 26, in which the internal threads are formed in a nut received in the base.

28. The material handling implement of claim 25, in which the threaded member engages an internal recess formed in the abutment, and a head of the threaded member is retained in an opening formed in the abutment opposite the internal recess.

29. The material handling implement of claim 25, in which the abutment is displaceable into contact with the surface of the wear component in response to the rotation of the threaded member.

30. The material handling implement of claim 29, in which the wear component is in contact with a forward edge of the lip when the abutment contacts the rearwardly facing surface of the wear component.

31. The material handling implement of claim 24, in which the abutment comprises a forwardly extending projection configured to engage a rearwardly opening recess formed in the wear component.

32. The material handling implement of claim 31, in which the projection is configured to react lateral forces applied to the wear component.

33. The material handling implement of claim 24, in which the base is welded to the lip.

34. The material handling implement of claim 24, in which the abutment is releasably secured to the base without any weld.

35. The material handling implement of claim 24, in which the abutment is replaceable without removal of any weld.

36. A method of reacting forces applied to a wear component of a material handling implement, the method comprising:

rigidly attaching a base of an abutment assembly to a lip of the material handling implement;

then securing the wear component on the lip; and then displacing an abutment of the abutment assembly relative to the base, the displacing comprising the abutment contacting a surface of the wear component, in which, when the abutment contacts the wear component surface, a first gap exists between the abutment and a forward face of the base and a second gap exists between the abutment and a rearward face of the base.

* * * * *